US007950087B2

(12) United States Patent
Han et al.

(10) Patent No.: US 7,950,087 B2
(45) Date of Patent: May 31, 2011

(54) COMMERCIAL LAUNDRY SYSTEM AND METHOD FOR CONTROLLING THE SAME

(75) Inventors: In Hee Han, Gyeongsangnam-do (KR); Nam Yeong Heo, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 553 days.

(21) Appl. No.: 12/031,485

(22) Filed: Feb. 14, 2008

(65) Prior Publication Data

US 2008/0196171 A1 Aug. 21, 2008

(30) Foreign Application Priority Data

Feb. 15, 2007 (KR) ..... 10-2007-0016128

(51) Int. Cl.
*D06F 33/02* (2006.01)

(52) U.S. Cl. ..... 8/158; 68/3 R; 68/12.02

(58) Field of Classification Search ..... 68/3 R, 68/19, 19.2

See application file for complete search history.

(56) References Cited

U.S. PATENT DOCUMENTS

| | | | | | |
|---|---|---|---|---|---|
| 2,566,488 | A | * | 9/1951 | Gould | 68/20 |
| 3,076,107 | A | * | 1/1963 | Johnston | 307/141.4 |
| 3,594,784 | A | * | 7/1971 | Femminella | 340/286.06 |
| 3,774,742 | A | * | 11/1973 | Magnanelli | 194/342 |
| 3,833,104 | A | * | 9/1974 | Blum | 194/350 |
| 3,958,586 | A | * | 5/1976 | Schnelle | 134/68 |
| 4,555,639 | A | * | 11/1985 | Melek | 307/38 |
| 4,663,538 | A | * | 5/1987 | Cotton et al. | 307/38 |
| 4,724,334 | A | * | 2/1988 | Melek | 307/113 |
| 4,773,020 | A | * | 9/1988 | Anderson et al. | 705/418 |
| 4,999,763 | A | * | 3/1991 | Ousborne | 700/11 |
| 5,212,644 | A | * | 5/1993 | Frisch | 705/418 |
| 5,299,862 | A | * | 4/1994 | Rankine | 312/329 |
| 5,647,231 | A | * | 7/1997 | Payne et al. | 68/12.01 |
| 5,799,281 | A | * | 8/1998 | Login et al. | 705/1.1 |
| 6,061,668 | A | * | 5/2000 | Sharrow | 705/400 |
| 6,618,772 | B1 | * | 9/2003 | Kao et al. | 710/15 |
| 7,410,095 | B2 | * | 8/2008 | Selover | 232/16 |

FOREIGN PATENT DOCUMENTS

| | | | |
|---|---|---|---|
| CN | 1941007 | * | 4/2007 |
| GB | 1 550 480 | * | 8/1979 |
| GB | 2 234 837 | * | 2/1991 |
| JP | 2001-129300 | * | 5/2001 |
| WO | WO 85/02701 | * | 6/1985 |

* cited by examiner

*Primary Examiner* — Frankie L Stinson

(74) *Attorney, Agent, or Firm* — Birch, Stewart, Kolasch & Birch, LLP

(57) ABSTRACT

A commercial laundry system is disclosed. The commercial laundry system includes a plurality of laundry machines that independently perform washing and/or drying, a plurality of receiving devices provided at the respective laundry machines for receiving a signal, and a single payment device for transmitting a signal for use permission to the receiving device of any one of the laundry machines and separately controlling authorities to use the laundry machines.

30 Claims, 4 Drawing Sheets

COMMERCIAL LAUNDRY SYSTEM AND METHOD FOR CONTROLLING THE SAME

CROSS-REFERENCE TO RELATED APPLICATION

This application claims the benefit of Korean Patent Application No. 10-2007-0016128, filed on Feb. 15, 2007, which is hereby incorporated by reference in its entirety as if fully set forth herein.

BACKGROUND OF THE INVENTION

1. Field of the Invention

The present invention relates to a machine that performs washing and/or drying, and more particularly, to a laundry system that is capable of commercially operating the machine that performs washing and/or drying.

2. Discussion of the Related Art

Generally, a laundry machine is a machine that is capable of doing laundry through washing, rinsing, and spin-drying processes. The laundry machine may be generally classified as a washing machine that performs only washing or a drying machine that performs only drying. In recent years, a complex laundry machine that is capable of performing both washing and drying has been widely used. Based on the direction in which laundry is put into the laundry machine, the laundry machine may be also classified as a front loading type laundry machine and a top loading type laundry machine.

Based on the purpose of use, on the other hand, the laundry machine may be classified as a household laundry machine or a commercial laundry system. The household laundry machine is installed in a house for doing laundry belonging to family members residing in the house. On the other hand, the commercial laundry system includes a plurality of laundry machines generally installed in a laundry. A customer who wishes to do laundry may use the commercial laundry system through his/her payment of predetermined laundry charges.

The commercial laundry system is manufactured for an owner of the laundry, seeking to make large profits. For this reason, it is required for the commercial laundry system to be designed with high durability and safety. In addition, it is required for the commercial laundry system to be designed such that the owner of the laundry makes large profits by the commercial laundry system. Consequently, there is a fundamental necessity for an apparatus and method for controlling the commercial laundry system to maximize profits of the owner of the laundry.

SUMMARY OF THE INVENTION

Accordingly, the present invention is directed to a commercial laundry system and a method for controlling the same that substantially obviates one or more problems due to limitations and disadvantages of the related art.

An object of the present invention is to provide a commercial laundry system that is capable of making large profits and a method for controlling the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a commercial laundry system includes a plurality of laundry machines that independently perform washing and/or drying, a plurality of receiving devices provided at the respective laundry machines for receiving a signal, and a single payment device for transmitting a signal for use permission to the receiving device of any one of the laundry machines and separately controlling authorities to use the laundry machines.

Preferably, the payment device is disposed separately from the laundry machines and transmits a signal to the receiving device only when a payment of predetermined charges is completed.

Preferably, the payment device is configured to arbitrarily transmit a signal for use permission to the receiving device of any unused one of the laundry machines or allow a user to select any unused one of the laundry machines.

Preferably, the receiving device receiving the signal supplies power to the corresponding laundry machine having the receiving device or sets buttons on a control panel of the corresponding laundry machine having the receiving device operatable.

Preferably, the payment device remotely controls an operation of the corresponding laundry machine having the receiving device by which the signal is received. More specifically, the payment device informs the laundry machine of an operation desired by a user. Also, the payment device commands the laundry machine to perform the informed operation.

Preferably, the laundry machines are arranged in more than one row and column.

In another aspect of the present invention, a control method for a commercial laundry system comprises the steps of: depositing predetermined charges in a single payment device; transmitting a signal for use permission to any one of receiving devices provided respectively at a plurality of laundry machines when the payment of the predetermined charges is completed, setting the laundry machine having the receiving device by which the signal is received operatable, and performing a predetermined operation using the operatable laundry machine.

Consequently, the commercial laundry system and the method for controlling the same according to the present invention are capable of greatly increasing the profits of the laundry.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
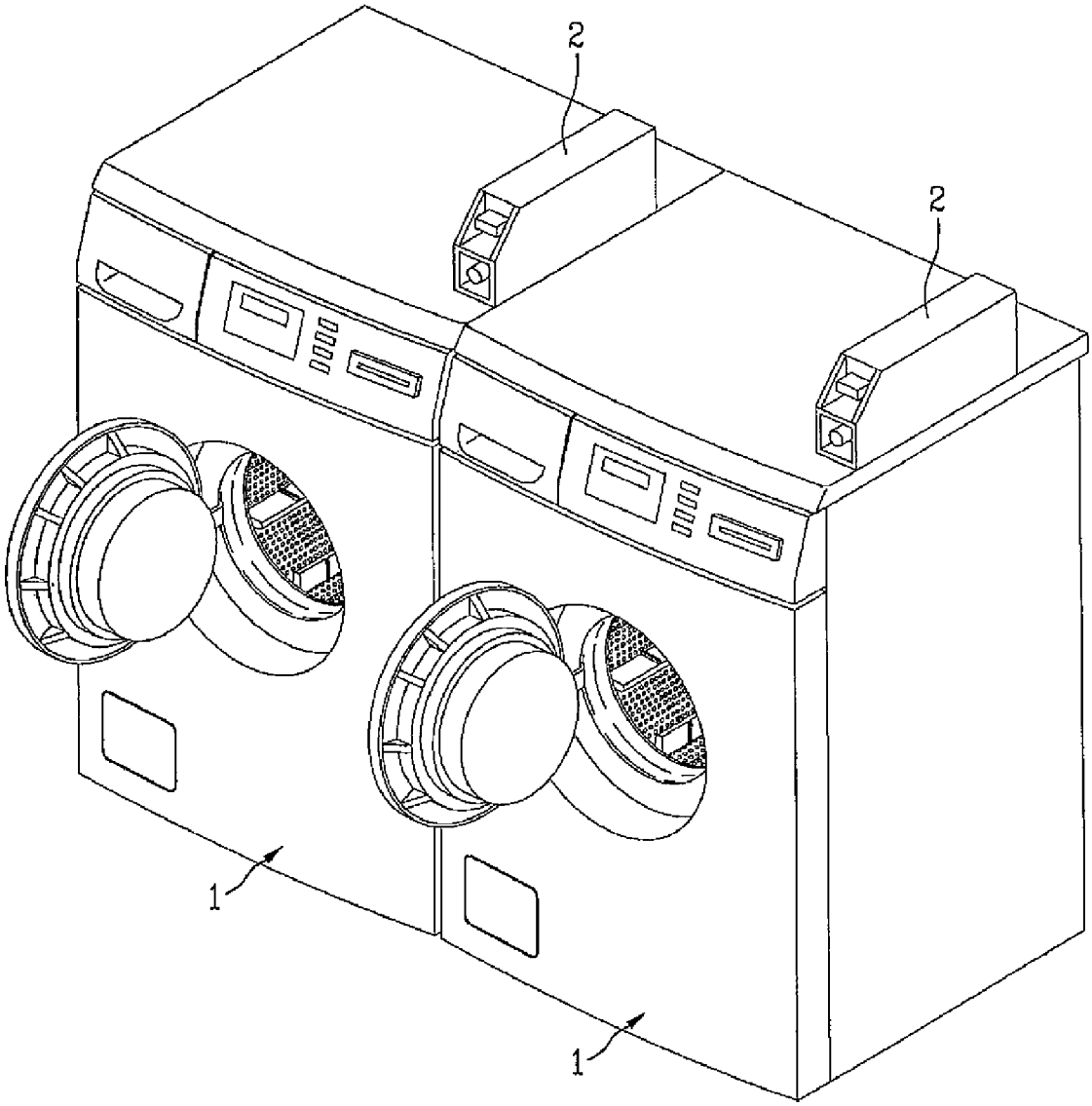
FIG. 1 is a perspective view illustrating an embodiment of a commercial laundry system according to the present invention.

FIG. 1 is a perspective view illustrating an embodiment of a commercial laundry system according to the present invention.

The commercial laundry system includes a plurality of independent laundry machines 1. Each laundry machine 1 may perform only washing or drying. Alternatively, each laundry machine 1 may perform both washing and drying a payment device 2 for allowing a customer of a laundry, i.e. a user of the laundry machine to pay predetermined laundry charges is mounted to each laundry machine 1. The payment device 2 is located at the top of the laundry machine 1 such that the user can easily deposit the laundry charges in the payment device 2. Based on payment means, the payment device 2 may classified as a coin box or a card reader. The payment device 2 may includes both the coin box and the card reader. The coin box allows a user to pay laundry charges using coins, whereas the card reader allows a user to pay laundry charges using a credit card or other electronic payment instruments, such as a magnetic card and an integrated circuit (IC) card.

When a user pays predetermined charges to use any unused one of the laundry machines 1 using a payment device 2 mounted to the laundry machine selected by him/her, the selected laundry machine is operatable. Subsequently, when the user selects a washing method (and/or a drying method) and time thereof on the operatably-set laundry machine 1, the laundry machine 1 washes the laundry based on the selected washing/drying method and time. In this way, an owner of a laundry provides washing and/or drying services based on the laundry system to a user, thereby making profits.

However, when one payment device 2 is mounted to each laundry machine 1, as shown in FIG. 1, it is required for each payment device 2 to be mounted on the top of the corresponding laundry machine 1. To this end, as shown in FIG. 1, it is required for the laundry machines 1 to be arranged in a line, but it is not possible to dispose the laundry machines 1 in other formations increasing the spatial utilization of the laundry machines. The restriction in the disposition of the laundry machines greatly reduces the number of laundry machines 1 that can be installed in a specific space of a laundry and thus reduces profits that can be made by the laundry.

Also, as previously mentioned, the commercial laundry system includes the plurality of payment devices 2, and the management of these payment devices 2 is a burden on the laundry. For example, it is troublesome to withdraw the laundry charges from the payment devices 2, and there is a great possibility that at least one of the payment devices 2 gets out of order. Consequently, the provision of the plurality of the payment devices 2 makes the management of the laundry inefficient, which restrains the increase in profits of the laundry.

Figure 2:
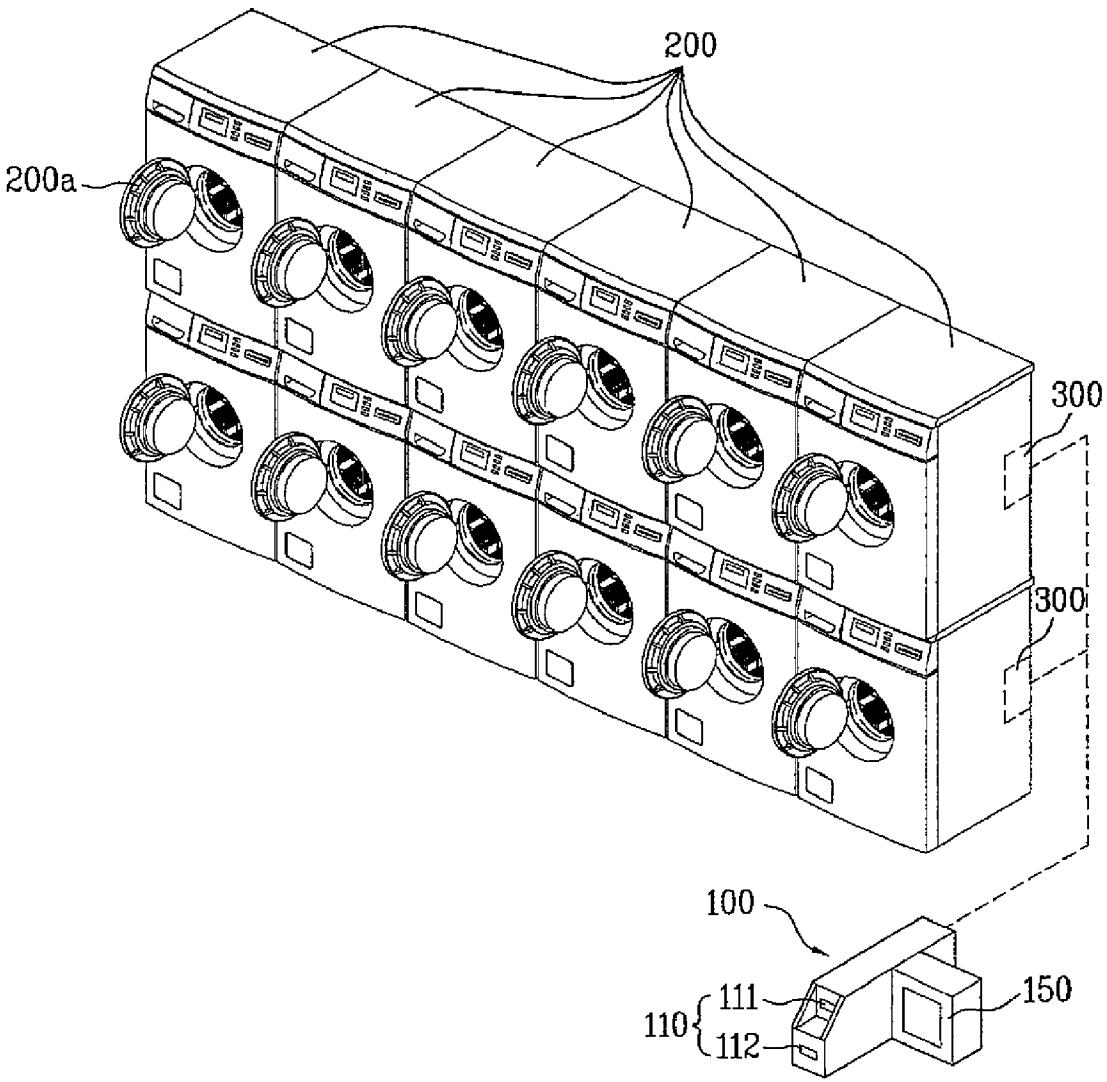
FIG. 2 is a perspective view illustrating another embodiment of a commercial laundry system according to the present invention.
Figure 3:
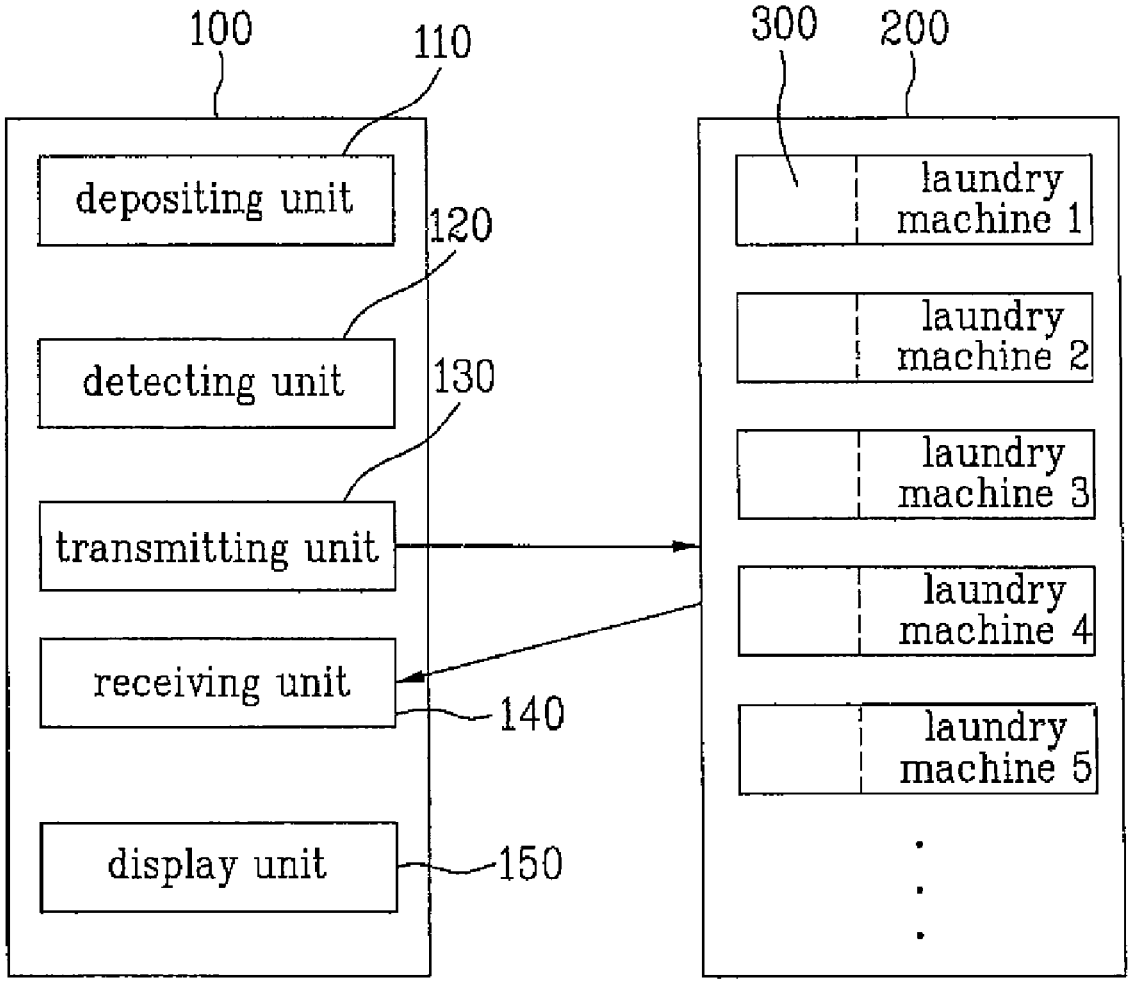
FIG. 3 is a block diagram schematically illustrating the commercial laundry system according to the present invention.
Figure 4:
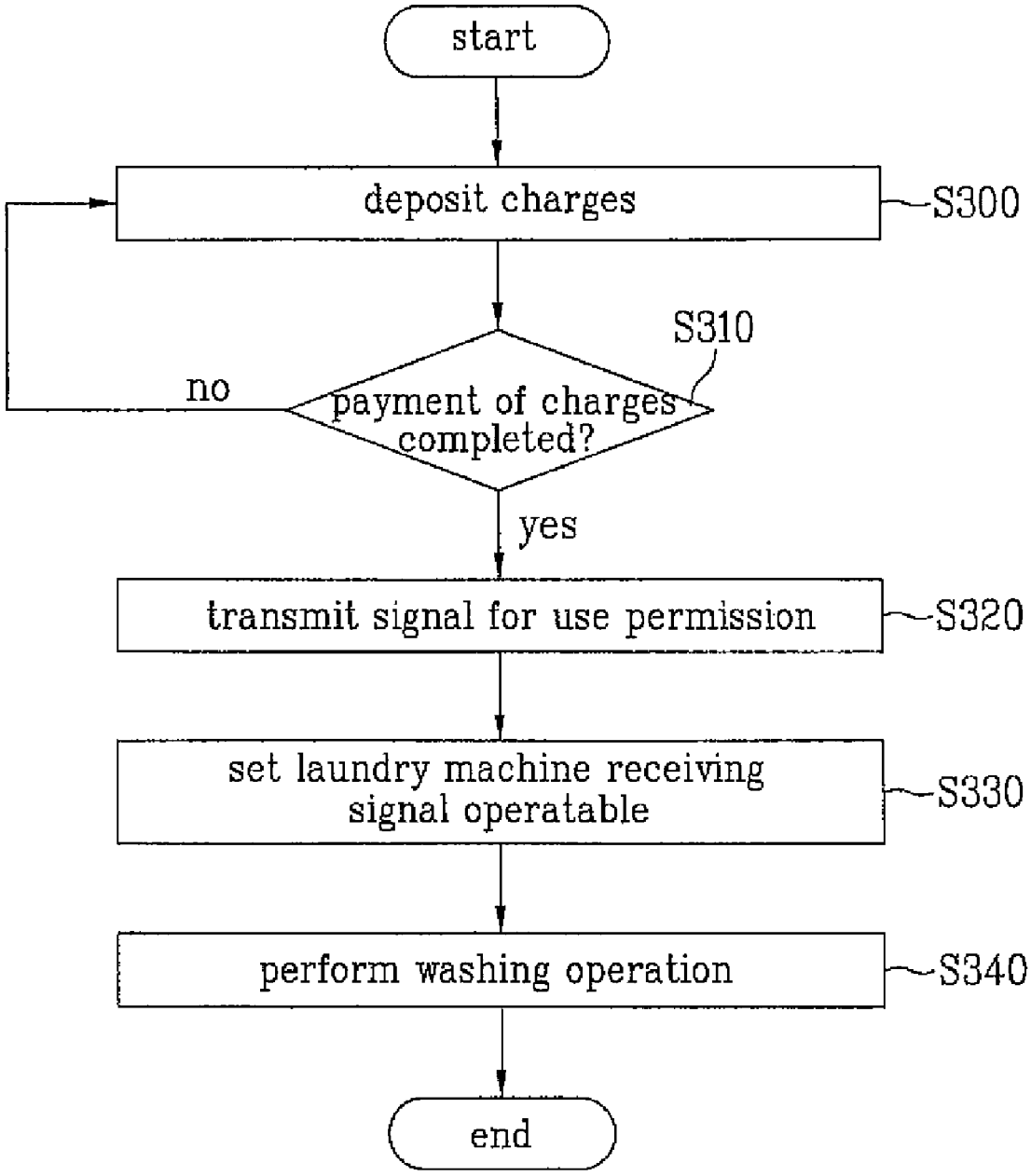
FIG. 4 is a flow chart illustrating a method for controlling the commercial laundry system according to the present invention.

FIGS. 2 to 4 illustrate another embodiment of a commercial laundry system according to the present invention. Hereinafter, the commercial laundry system according to the present invention will be described in detail with reference to FIGS. 2 to 4.

FIG. 2 is a perspective view illustrating another embodiment of a commercial laundry system according to the present invention, and FIG. 3 is a block diagram schematically illustrating the commercial laundry system of FIG. 2.

As shown in FIGS. 2 and 3, the commercial laundry system includes a plurality of laundry machines 200. Each laundry machine 200 may independently perform washing or drying. Alternatively, each laundry machine 200 may perform both washing and drying. Each laundry machine 200 has a receiving device 300 for receiving a signal. The commercial laundry system has a single payment device 100 for allowing users to pay charges to use the respective laundry machines 200. The payment device 100 transmits a signal for use permission to any one of the receiving devices 300. As a result, a user is allowed to use the corresponding laundry machine 200 with the receiving device 300 having received the signal. In this way, the payment device 100 controls authority to use the respective laundry machines 200 according to the transmission of the signal for use permission.

As shown in FIG. 3, the payment device 100 includes a depositing unit 110 and a transmitting unit 130. A user can deposit predetermined laundry charges in the payment device 100 using the depositing unit 110. As shown in FIG. 2, the depositing unit 110 includes a first slot 111 for coins and a second slot 112 for a credit card and other electronic payment instruments, such as a magnetic card, an IC card, and a smart card. In addition, the depositing unit 110 may include a radio frequency (RF) receiving unit for a RF card. When the payment of the laundry charges is completed, the transmitting unit 130 transmits a signal for use permission to the corresponding receiving device 300. Also, the transmitting unit 130 transmits various signals necessary to control the laundry machine 200 to the corresponding receiving device 300, which will be described below.

In addition, the payment device 100 further includes a detecting unit 120, a receiving unit 140, and a display unit 150. The detecting unit 120 detects whether laundry charges have been paid through the depositing unit 110 and allows the transmitting unit 130 to transmit a signal for use permission. The receiving unit 140 detects the state of the respective laundry machines 200. Specifically, the receiving unit 140 detects whether the respective laundry machines 200 are in use. To this end, although not shown, each laundry machine 200 may have a transmitting device for transmitting a signal related to whether the corresponding laundry machine is in use to the payment device 100, specifically the receiving unit 140 of the payment device 100. The display unit 150 basically displays information about the state of the respective laundry machines 200. More specifically, the display unit 150 basically displays information as to whether the respective laundry machines 200 are in use. Also, the display unit 150 may display information about washing and/or drying carried out by the respective laundry machines 200. For example, the display unit 150 may display conditions of washing and/or drying carried out by the respective laundry machines 200 and time left until the washing and/or drying carried out by the respective laundry machines 200 is completed. In addition to the above-mentioned information, other various kinds of information may be displayed on the display unit 150 as needed.

The display unit 150 may be a lamp. In this case, the payment device 100 may include a plurality of lamps assigned to the respective laundry machines 200. By turning the lamps on, the payment device 100 may display whether the respective laundry machines 200 are in use. Alternatively, the display unit 150 may be a display panel, such as a liquid crystal display (LCD) panel. In this case, it is possible to display the above-described various kinds of information as well as whether the respective laundry machines 200 are in use in more detail.

Also, each laundry machine 200, which is used with the payment device 100, includes a mechanism for performing washing and/or drying and a control unit for controlling the operation of the mechanism. The control unit of each laundry machine 200 is connected to the receiving device 300 of the corresponding laundry machine 200. The receiving devices 300 of the respective laundry machines 200 may be connected to the payment device 100 via communication cables. Alternatively, the receiving devices 300 of the respective laundry machines 200 may communicate with the payment device 100 in a wireless fashion.

In the commercial laundry system with the above-stated construction, the payment device 100 transmits a signal for use permission to any one of the available laundry machines, i.e., any unused one of the laundry machines 200, and the transmission of the signal is performed only when the payment of the laundry charges is completed, thereby controlling authorities to use the laundry machines 200. More specifically, when the payment of the laundry charges is completed, the payment device 100, i.e., the transmitting unit 130, arbitrarily selects any unused one of the laundry machines 200, and transmits a signal for use permission to the selected laundry machine. Consequently, a user is not allowed to select any unused one of the laundry machines 200. When the number of the laundry machines 200 not being used is only one, the payment device 100 directly transmits the signal for use permission to the unused laundry machine 200. Alternatively, when the payment of the laundry charges is completed, the user may be allowed to select any unused one of the laundry machines 200 through the use of the payment device 100. In this case, the display unit 150 is configured to display unused laundry machines 200. As previously described, for example, the display unit 150 may be a lamp or a display panel. Also, when the display unit 150 further has an electric element, such as a button or a switch, the user can select any unused one of the laundry machines 200. The electric element may be provided at the payment device 100 separately from the display unit 150. When the display unit 150 is a display panel (LCD panel) having a touch pad, the user can directly and conveniently select any unused one of the laundry machines 200 displayed on the display panel through the use of the touch pad. When the user selects any unused one of the laundry machines 200, the payment device 100 transmits a signal for use permission to the receiving device 300 of the selected laundry machine 200 in the same manner. The selection of any unused one of the laundry machines 200 is possible through the detection of the state of the laundry machines 200 by the payment device 100. As previously described, the detection is carried out by the receiving unit 140 of the payment device 100 and the transmitting units (not shown) of the laundry machines.

Also, when the receiving device 300 receives the signal for use permission from the payment device 100, the receiving device 300 having received the signal for use permission sets the corresponding laundry machine 200 having such a receiving device in an operatable status. That is, the receiving device 300 having received the signal for use permission transmits a signal to the control unit of the corresponding laundry machine 200, and the control unit, having received the signal, sets relevant components of the corresponding laundry machine 200 in the operatable status. More specifically, once the receiving device 300 receives a signal from the payment device 100, the receiving device 300, having received the signal, transmits a signal to the control unit of the corresponding laundry machine 200 having such a receiving device 300, whereby power is supplied to the corresponding laundry machine 200. Also, when the receiving device 300 receives a signal from the payment device 100, the receiving device 300 having received the signal transmits a signal to the control unit of the corresponding laundry machine 200 having such a receiving device 300, thereby activating the buttons provided on the control panel of the corresponding laundry machine 200. That is, only when the receiving device 300 receives a signal from the payment device 100 and transmits a signal to the control unit of the corresponding laundry machine 200, the buttons on the control panel generate a predetermined electrical signal to be transmitted to the control unit, and the user is allowed to manipulate the buttons to use the corresponding laundry machine 200. If the receiving device 300 does not receive a signal from the payment device 100, the buttons cannot generate any electrical signal, and the user is not allowed to use the corresponding laundry machines 200. Alternatively, the payment device 100 may directly set the corresponding laundry machine 200 having the receiving device 300 by which the signal has been received operatable, in place of the receiving device 300. In this case, the payment device 100 has includes a power control unit (not shown) for directly controlling the supply of power to the laundry machines 200. The power control unit may be a relay for turning the powers of the respective laundry machines 200 on or off. Consequently, after transmitting the signal for use permission, the payment device 100 may directly supply power to the corresponding laundry machine 200 through the use of the power control unit.

As previously described, meanwhile, when any unused one of the laundry machines 200 is set operatable by the payment device 100 and the corresponding receiving device 300, the user may directly manipulate the control panel of the operatably-set laundry machine 200 to command the laundry machine 200 that the laundry machine 200 should perform washing and/or drying desired by the user. Nevertheless, the payment device 100 may remotely control the operation of the corresponding laundry machine 200 having the receiving device 300 by which the signal has been received. More specifically, the user may inform the operatably-set laundry machine 200 of a predetermined operation through the use of the payment device 100 in advance, and may also command the operatably-set laundry machine 200 that the laundry machine 200 should perform the informed operation. For example, when the payment unit 100 further has an electric element, such as a button or a switch, the user can inform the laundry machine 200 of the predetermined operation through the use of the electric element. Also, when the display unit 150 of the payment device 100 is a display panel (LCD panel) having a touch pad, the user can conveniently inform the laundry machine 200 of the operations set at the respective menus displayed on the display panel through the use of the touch pad. When the user informs a predetermined operation set on the payment device 100, as previously described, the transmitting unit 130 of the payment device 100 transmits a predetermined signal for informing the desired operation to the receiving device 300 of the corresponding laundry machine 200. Also, the receiving device 300 transmits the signal to the control unit of the corresponding laundry machine 200. Here, the signal may include predetermined series of operations, such as a laundry course or a particular operation selected by the user, transmitted to the corresponding laundry machine 200. Also, the user may transmit the detailed setting to the operations through the use of the payment device 100. When a operation is transmitted to the corresponding laundry machine 200, the user walks to the corresponding laundry machine 200 and puts laundry therein, and commands the beginning of the previously informed operation to the corresponding laundry machine 200 such that the corresponding laundry machine 200 can perform the informed operation. On the other hand, when the laundry has already put in the corresponding laundry machine 200, the user may firstly inform the corresponding laundry machine 200 of the desired operation through the use of the payment device 100, and then may directly command the corresponding laundry machine 200 to perform the previously informed operation through the use of the payment device 100 without approaching the corresponding laundry machine 200. The signal exchange procedure to command the performance of the informed operation is similar to the signal exchange procedure to inform the operation as described above. Consequently, it is possible for the user to conveniently wash and/or dry the laundry by the transmission and performance of the desired operation through the use of the previously mentioned payment device 100.

Also, when the operation of the corresponding laundry machine 200 is completed, the payment device 100 may turn the power of the corresponding laundry machine 200 off. Consequently, the unnecessary supply of power to the corresponding laundry machine 200 is prevented, and therefore, the maintenance expenses at the laundry are greatly reduced. Turning the power of the corresponding laundry machine 200 off is possible by detecting the state of the corresponding laundry machine 200 off. The detection is carried out by the receiving unit 140 of the payment device 100, as previously described.

The payment devices 2 are mounted on the respective laundry machines 1 in FIG. 1, whereas a single payment device 100 is disposed separately from a plurality of laundry machines 200 in FIG. 2. Since the commercial laundry system adopts a single payment device 100 which could integrally control a plurality of laundry machines 200, such a payment device 100 may be separated from the laundry machines 200. Consequently, as shown in FIG. 2, the laundry machines 200 may be arranged horizontally and stacked vertically. Specifically, the laundry machines 200 may be arranged more than one row and column. To this end, each laundry machine 200 preferably has a door 200*a* mounted to the front thereof. Consequently, an increased number of the laundry machines 200 may be disposed in a limited space of the laundry, and therefore, the profits of the laundry may increase.

Hereinafter, a method for controlling the above commercial laundry system will be described with reference to FIG. 4.

First, a user, i.e., a customer, deposits predetermined laundry charges in the depositing unit 100 of the single payment device 100 (S300).

Subsequently, the detecting unit 200 of the payment device 100 determines whether the payment of the laundry charges has been completed (S310).

When it is determined that the payment of the laundry charges has been completed, the payment device 100 transmits a signal for use permission to any one of the receiving units provided at the respective laundry machines 200 (S320).

At the transmission step (S320), the payment device 100 arbitrarily transmits the signal to the receiving device 300 belonging to any unused one of the laundry machines 200. More specifically, the receiving unit 140 of the payment device 100 receives signal as to whether the laundry machines 200 are being used from the transmitting units (not shown) of the laundry machines 200. Subsequently, the transmitting unit 130 of the payment device 100 arbitrarily selects any unused one of the laundry machines 200 and transmits a signal for use permission to the receiving device 300 of the selected laundry machine 200.

At the transmission step (S320), on the other hand, the user may select any unused one of the laundry machines 200 through the use of the payment device 100, and the payment device 100 may transmit the signal to the receiving device 300 of the selected laundry machine 200. More specifically, the display unit 150 of the payment device 100 displays unused ones of the laundry machines 200. The user may select an unused one of the laundry machines 200 through the use of the other switch or button provided at the display unit 150 or the payment device 100. After the selection of the unused one of the laundry machines 200 by the user is completed, the transmitting unit 130 of the payment device 100 transmits a signal for use permission to the receiving device 300 of the selected laundry machine 200.

After the transmission step (S320), the laundry machine 200 having the receiving device 300 by which the signal has been received is set operatable (S330).

First, the laundry machine 200 is supplied with power, such that the laundry machine 200 is operatable, at the setting step (S330). More specifically, the receiving device 300 having received the signal transmits a signal to the control unit of the laundry machine 200 having such a receiving device 300. Subsequently, the control unit controls relevant devices to supply power to the corresponding laundry machine 200.

At the setting step (S330), on the other hand, the buttons on the control panel of the laundry machine 200 may be activated. The receiving device 300, having received the signal, transmits a predetermined signal to the control unit of the laundry machine 200. Subsequently, the control unit allows the buttons of the control panel to generate a predetermined electrical signal. Consequently, as the user manipulates the buttons, an electrical signal generated from the buttons, may be transmitted to the control unit of the laundry machine 200 such that the laundry machine 200 can perform a predetermined operation assigned to the electrical signal. If the receiving device 300 does not receive a signal from the payment device 100, and therefore, a predetermined signal is not transmitted to the control unit of the laundry machine 200, the buttons cannot generate an electrical signal, and therefore, the user is not allowed to use the laundry machine 200.

After the setting step (S330), the operatable laundry machine 200 performs a predetermined operation (S340).

First, the user approaches the operatably-set laundry machine 200 and directly manipulates the control panel of the laundry machine 200 to command the laundry machine 200, such that the laundry machine 200 performs a desired operation, at the performance step (S340). Subsequently, the user may directly manipulate the control panel again such that the commanded operation can be performed by the laundry machine 200.

In the performance step (S340), on the other hand, the user may remotely control the operation of the laundry machine 200 through the use of the payment device 100. That is, the payment device 100 transmits a predetermined signal for controlling the operation of the laundry machine 200 to the receiving device 300.

More specifically, the user may inform the operatably set laundry machine 200 of a desired operation in advance through the use of the payment device 100. In this case, the transmitting unit 130 of the payment device 100 transmits a signal including the information with regard to the operation desired by the user and the detailed setting related to the operation to the receiving device 300 of the operatably-set laundry machine 200. The receiving device 300 transmits the signal to the control unit of the laundry machine 200, and thereby the laundry machine 200 is ready to perform the informed operation. Subsequently, the user approaches the corresponding laundry machine 200 and puts laundry in the laundry machine 200. After that, the laundry machine 200 performs the commanded operation without the user's further manipulation of the laundry machine 200 for setting the operation.

Alternatively, subsequent to informing the desired operation, the user may directly command the operatably-set laundry machine 200 to perform the previously informed operation through the use of the payment device 100. When the laundry has already put in the laundry machine 200, the user may command the corresponding laundry machine 200 to immediately perform the previously informed operation through the use of the payment device 100 without approaching the corresponding laundry machine 200. Actually, the transmitting unit 130 of the payment device 100 transmits a signal for commanding the performance of the previously informed operation to the receiving device 300. The receiving device 300 transmits the signal to the control unit of the laundry machine 200. The control unit drives a related mechanism according to the previously informed operation.

When the operation of the laundry machine 200 is completed after the performance step (S340), the payment device 100 may automatically turn the power of the laundry machine 200 off. In this case, the receiving unit 140 of the payment device 100 receives a signal for informing the completion of the predetermined operation from the transmitting unit (not shown) of the laundry machine 200, and the transmitting unit 130 of the payment device 100 transmits a signal for commanding that the power of the laundry machine 200 be turned off to the receiving unit 140 of the payment device 100. Subsequently, the receiving unit 140 of the receiving unit 140 of the payment device 100 transmits a predetermined signal to the control unit of the corresponding laundry machine 200 such that the power of the laundry machine 200 can be turned off.

As apparent from the above description, the single payment device directly controls authorities to use the plurality of laundry machines, and also substantially controls the operations of the respective laundry machines. Consequently, the system and method according to the present invention greatly increases users' convenience and efficiency in management of the laundry. Also, a relatively increased number of laundry machines may be disposed in a limited space of the laundry through the use of the single payment device. Consequently, it is possible for the laundry to make greater profits through the use of the system and method according to the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A commercial laundry system comprising:

a plurality of laundry machines that independently perform washing and/or drying;

a plurality of receiving devices provided at the respective laundry machines, and receiving a signal; and a single payment device for transmitting a signal for permitting a use to the receiving device of any one of the laundry machines, and separately controlling authorities to use the laundry machines, wherein the payment device arbitrarily transmits the signal for permitting the use to the receiving device of any unused one of the laundry machines, immediately after a payment of predetermined charges on behalf of a user.

2. The commercial laundry system according to claim 1, wherein the payment device is disposed separately from the laundry machines.

3. The commercial laundry system according to claim 1, wherein the payment device transmits the signal to the receiving device only when a payment of predetermined charges is completed.

4. The commercial laundry system according to claim 1, wherein the payment device is configured to allow a user to select any unused one of the laundry machines.

5. The commercial laundry system according to claim 1, wherein the payment device includes a display unit for displaying unused ones of the laundry machines and allowing a user to select any one of the displayed laundry machines.

6. The commercial laundry system according to claim 1, wherein the payment device is configured to detect a state of the laundry machines.

7. The commercial laundry system according to claim 6, wherein the state of the laundry machines includes whether the laundry machines are in use.

8. The commercial laundry system according to claim 1, wherein the receiving device receiving the signal sets the corresponding laundry machine having the receiving device to be operable.

9. The commercial laundry system according to claim 1, wherein the receiving device receiving the signal supplies power to the corresponding laundry machine having the receiving device.

10. The commercial laundry system according to claim 1, wherein the receiving device receiving the signal sets buttons on a control panel of the corresponding laundry machine having the receiving device to be activated, such that the user manually operates the corresponding laundry machine.

11. The commercial laundry system according to claim 1, wherein the payment device remotely controls an operation of the corresponding laundry machine having the receiving device by which the signal is received.

12. The commercial laundry system according to claim 1, wherein the payment device transmits a signal for controlling the laundry machine to the receiving device.

13. The commercial laundry system according to claim 1, wherein the payment device instructs the laundry machine to perform a specific operation related to the washing and/or the drying and detailed settings of the specific operation.

14. The commercial laundry system according to claim 1, wherein the laundry machines are arranged vertically and horizontally.

15. The commercial laundry system according to claim 1, wherein the laundry machines are arranged in more than one row and column.

16. The commercial laundry system according to claim 1, wherein each of the laundry machines has a door mounted to a front thereof.

17. The commercial laundry system according to claim 1, wherein the payment device includes:

a depositing unit for allowing a user to deposit charges, and a transmitting unit for transmitting the signal for permitting the use to the receiving device of the laundry machine when a deposition of the charges is completed.

18. The commercial laundry system according to claim 17, wherein the payment device further includes a detecting unit for detecting whether the deposition of the charges is completed.

19. The commercial laundry system according to claim 17, wherein the payment device further includes a receiving unit for detecting a state of the laundry machine.

20. The commercial laundry system according to claim 17, wherein the payment device further includes a display unit for displaying a state of the laundry machine.

21. The commercial laundry system according to claim 1, wherein the payment device turns power of the laundry machine off when an operation of the laundry machine is completed.

22. A control method for a commercial laundry system, comprising the steps of:

depositing predetermined charges in a single payment device;

when a payment of the predetermined charges is completed, transmitting a signal for permitting a use to any one of receiving devices provided respectively to a plurality of laundry machines;

setting the laundry machine having the receiving device which receives the signal operable; and performing a predetermined operation using the laundry machine, wherein the step of transmitting the signal for use permission comprises arbitrarily transmitting the signal by the payment device to any unused one of the laundry machines, immediately after the payment of the predetermined charges on behalf of a user.

23. The control method according to claim 22, wherein the step of transmitting the signal for use permission comprises selecting any unused one of the laundry machines by a user and transmitting the signal from the payment device to the receiving device of the selected laundry machine.

24. The control method according to claim 22, wherein the step of setting the laundry machine comprises supplying power to the laundry machine.

25. The control method according to claim 22, wherein the step of setting the laundry machine comprises setting buttons on a control panel of the laundry machine activated, such that the user manually operates the corresponding laundry machine.

26. The control method according to claim 22, wherein the step of performing the predetermined operation comprises directly operating the operable laundry machine by a user.

27. The control method according to claim 22, wherein the step of performing the predetermined operation comprises remotely controlling the operation of the operable laundry machine through a use of the payment device by a user.

28. The control method according to claim 22, wherein the step of performing the predetermined operation comprises transmitting a signal for controlling the laundry machine from the payment device to the receiving device of the operable laundry machine.

29. The control method according to claim 22, wherein the step of performing the predetermined operation comprises instructing the laundry machine to perform a specific operation related to the washing and/or drying and detailed settings of the specific operation by using the payment device.

30. The control method according to claim 22, further comprising the step of:

turning power of the laundry machine off when the operation of the laundry machine is completed.

* * * * *